US006836205B2

(12) United States Patent
Scott et al.

(10) Patent No.: US 6,836,205 B2
(45) Date of Patent: Dec. 28, 2004

(54) THERMAL SWITCH CONTAINING RESISTANCE TEMPERATURE DETECTOR

(75) Inventors: Byron G Scott, Arlington, WA (US); George D Davis, Bellevue, WA (US)

(73) Assignee: Honeywell International, Inc., Morristown, NJ (US)

( * ) Notice: Subject to any disclaimer, the term of this patent is extended or adjusted under 35 U.S.C. 154(b) by 0 days.

(21) Appl. No.: 09/965,987

(22) Filed: Sep. 27, 2001

(65) Prior Publication Data

US 2002/0060622 A1 May 23, 2002

Related U.S. Application Data

(60) Provisional application No. 60/237,874, filed on Oct. 4, 2000.

(51) Int. Cl.[7] ..... H01H 37/52; H01H 37/02

(52) U.S. Cl. ..... 337/3; 337/36; 337/53; 337/79; 337/299

(58) Field of Search ..... 337/1, 2, 3, 12, 337/13, 16, 36, 53, 79, 85, 89, 299, 333, 343, 365, 376, 417

(56) References Cited

U.S. PATENT DOCUMENTS 3,768,057 A * 10/1973 Sekira et al. ..... 337/349
4,037,316 A * 7/1977 Stoll ..... 29/622
4,166,268 A * 8/1979 Beck ..... 337/309
4,306,210 A * 12/1981 Saur ..... 337/2
4,568,904 A * 2/1986 Takahashi et al. ..... 337/140
4,842,419 A * 6/1989 Nietert ..... 374/145
5,048,974 A * 9/1991 Dupuy ..... 374/142
5,422,788 A * 6/1995 Heinen et al. ..... 361/705
5,828,284 A * 10/1998 Huang ..... 337/37
5,877,670 A * 3/1999 Sehlhorst et al. ..... 337/302
5,892,428 A * 4/1999 Hsu ..... 337/363
6,075,436 A * 6/2000 Hsu ..... 337/363
6,078,246 A * 6/2000 Davis et al. ..... 337/347

FOREIGN PATENT DOCUMENTS

GB 2135128 A * 8/1984 ..... H01H/37/30

OTHER PUBLICATIONS

"Two–terminal IC Temperature Transducer," product description, pp. 1–10, Analog Devices, Norwood MA, 1997.

* cited by examiner

*Primary Examiner*—Anatoly Vortman
(74) *Attorney, Agent, or Firm*—Charles J. Rupnick

(57) ABSTRACT

A multiple output thermal detection and protection device providing an output signal representative of the temperature sensed by the device, and further providing a positive output signal representative of the sensed temperature reaching a predetermined set point temperature.

36 Claims, 10 Drawing Sheets

THERMAL SWITCH CONTAINING RESISTANCE TEMPERATURE DETECTOR

This application claims the benefit of U.S. Provisional Application Ser. No. 60/237,874, filed in the names of Byron G. Scott and George D. Davis on Oct. 4, 2000, the complete disclosure of which is incorporated herein by reference.

FIELD OF THE INVENTION

The present invention is directed to temperature sensors and, more particularly, to snap-action thermal switches and electrical temperature sensors.

BACKGROUND OF THE INVENTION

Snap-action thermal switches are utilized in a number of satellite applications, such as temperature control of batteries and hydrazine lines, and for overheat detection of mechanical devices such as motors and bearings. Current snap-action thermal switch designs typically provide open and closed functions only, whereby temperature data is available only at the instant the thermal switch operates. Current practice thus necessitates hard wiring of additional temperature sensors to sense a range of temperatures. These additional temperature sensors are typically installed in systems as subsystems that stand apart from the snap-action thermal switch systems that provide overheat protection, and thus increase overall system complexity and weight. Such additional temperature sensor subsystems are typically less reliable than a snap-action thermal switch. Overall system reliability is generally degraded when such additional temperature sensor subsystems are relied upon.

SUMMARY OF THE INVENTION

The present invention overcomes the limitations of the prior art by providing a multiple output thermal detection and protection device that is capable of providing an output signal representative of the temperature sensed by the device, and further providing a positive output signal representative of the sensed temperature reaching a predetermined set point temperature.

The invention is embodied, for example, in a first two-terminal device having first and second terminals extending through and to both sides of a substantially planar header, the terminals being electrically isolated from the header. The first two-terminal device also includes a first stationary contact fixed adjacent to one end of the first terminal; a second contact fixed adjacent to one end of the second terminal and being movable between a first position spaced away from the first stationary contact in an open circuit structure and a second position in contact with the first stationary contact in a closed circuit structure; an upright tubular spacer fixed to and projecting from the header and surrounding the first and second contacts and the portions of the first and second terminals adjacent to the contacts; a housing fixed to the header and enclosing all of the spacer, the first and second contacts, and the portions of the first and second terminals adjacent to the contacts, the housing also extending beyond the spacer and cooperating with the spacer to form an annular space therebetween spaced away from the contacts; a bimetallic disc actuator captured within the annular space and being responsive to a sensed temperature of a predetermined set point to change state between a concave and a convex relationship to the electrical contacts, such that the disc actuator spaces the movable contact away from the stationary contact when in the concave relationship and the disc actuator permits the movable contact to contact the stationary contact when in the convex relationship; and an electrical temperature sensor sharing the first and second terminals in common with the respective first and second contacts and being structured to provide an output on one of the first and second terminals that is representative of the sensed temperature.

According to one aspect of the first embodiment of the invention, the disc actuator is structured to be in the concave relationship to the electrical contacts when the sensed temperature is below the predetermined sensed temperature, such that the circuit formed by the first and second contacts is open with the movable contact spaced away from he fixed contact, and the output of the electrical temperature sensor is available on the first nd second terminals.

According to another aspect of the first embodiment of the invention, the electrical temperature sensor is one of a resistance temperature detector (RTD), a platinum resistance thermal device (PRTD), a thermistor, a thermocouple, and a monolithic silicon temperature transducer.

The invention is also embodied, for example, in a three-terminal multiple output thermal detection and protection device having the output of the electrical temperature sensor is available whether the circuit formed by the first and second contacts is open or closed. Accordingly, the invention embodied as a three-terminal multiple output thermal detection and protection device includes: first, second and third terminals extending through and on either side of a substantially planar header, the three terminals being electrically isolated from the header and from one another; a first stationary contact fixed adjacent to one end of the first terminal; a second contact fixed adjacent to one end of the second terminal and being movable between a first position spaced away from the first stationary contact in an open circuit structure and a second position in contact with the first stationary contact in a closed circuit structure; an upright tubular spacer affixed to and projecting from the one side of the header and surrounding the first and second contacts, the portions of the first and second terminals adjacent to the contacts, and the third terminal; a housing enclosing the spacer, the first and second contacts, the portions of the first and second terminals adjacent to the contacts, and the third terminal, the housing extending beyond the spacer and cooperating with the spacer to form a space therebetween spaced away from the contacts; a bimetallic disc actuator captured within the space between the spacer and the housing and being responsive to a sensed temperature at or near a predetermined set point for changing state between a first pressing upon and a second spaced away relationship to the movable electrical contact, such that the disc actuator spaces the movable contact away from the stationary contact when in the first pressing upon relationship and the disc actuator permits the movable to move into contact with the stationary contact when in the second spaced away relationship; and an electrical temperature sensor sharing one of the first and second terminals in common with the respective first and second contacts and being coupled to the third terminal for providing an output signal representative of the sensed temperature.

According to one aspect of the three-terminal embodiment of the present invention, the disc actuator is structured to be in either of the first pressing upon relationship and the second spaced away relationship to the electrical contacts when the sensed temperature is below the predetermined sensed temperature.

According to still other aspects of the invention, the snap-action thermal switch is embodied as four-terminal and five-terminal switches.

According to another aspect of the three-terminal embodiment of the present invention, the electrical temperature sensor is one of a resistance temperature detector (RTD), a platinum resistance thermal device (PRTD), a thermistor, a thermocouple, and a monolithic silicon temperature transducer.

The invention also provides methods of accomplishing the same.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF PREFERRED EMBODIMENT

In the Figures, like numerals indicate like elements.

The present invention is a thermal protection device that provides temperature monitoring capability in combination with a normally open, snap-action thermal switch until the switch changes state from open to closed. This temperature monitoring capability in combination with a snap-action thermal switch provides several advantages over typical thermal protection devices. For example, additional wiring for a separate switch monitoring circuit which includes the device is eliminated, which reduces circuit complexity and increases system reliability. Separate mounting of the temperature sensor from the thermal switch is eliminated, which reduces the amount of space required by the monitoring and protection system. Meanwhile, the temperature monitoring capability in combination with a normally open, snap-action provides more accurate monitoring system temperature while providing reliable overheat protection.

Figure 1:
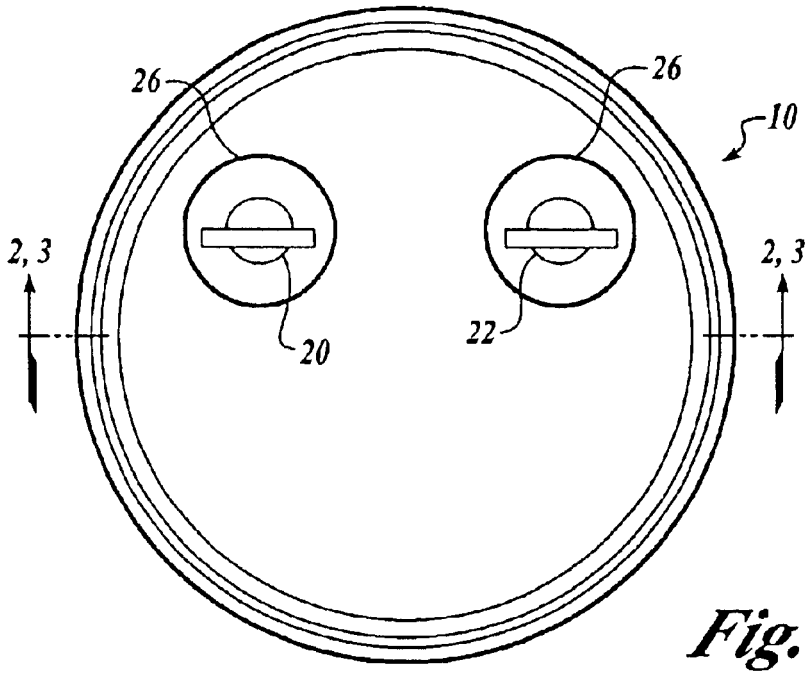
FIG. 1 is a top plan view of the present invention embodied as a snap-action thermal switch.
Figure 2:
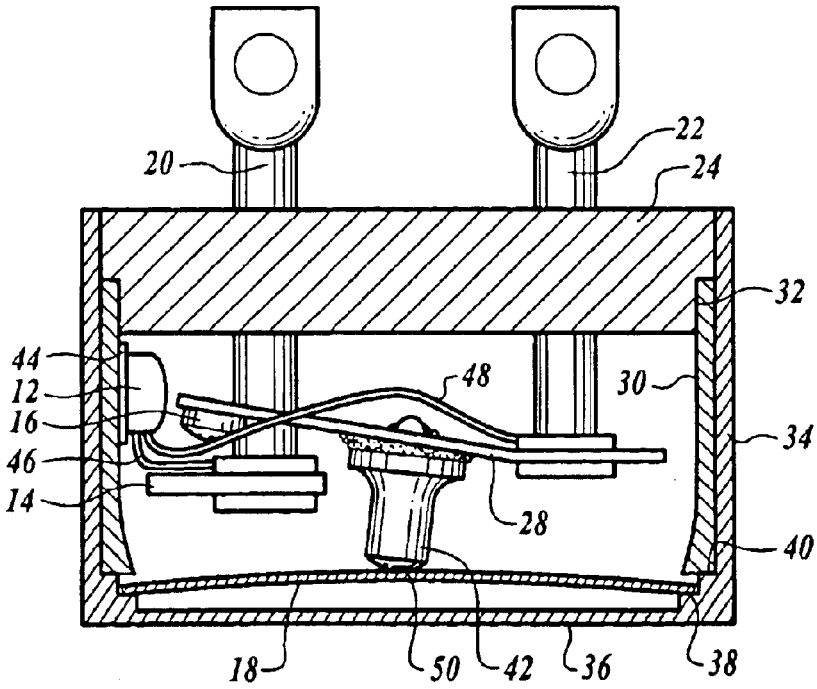
FIG. 2 is a cross-sectional view of the snap-action thermal switch of the present invention embodied as shown in FIG. 1 with the contacts open.

FIG. 1 is a top plan view and FIG. 2 is a cross-sectional view of the present invention embodied as a snap-action thermal switch 10 having an internal electrical temperature sensor 12. The thermal switch 10 includes a pair of electrical contacts 14, 16 that are mounted on the ends of a pair of spaced-apart, conductive terminal posts 20 and 22. The electrical contacts 14, 16 are moveable relative to one another between an open and a closed state under the control of a thermally-responsive actuator 18. According to one embodiment of the invention, the thermally-responsive actuator 18 is a well-known snap-action bimetallic disc that inverts with a snap-action as a function of a predetermined temperature between two bi-stable oppositely concave and convex states. In a first state, the bimetallic disc actuator 18 is convex relative to the relatively moveable electrical contacts 14, 16, whereby the electrical contacts 14, 16 are moved apart such that they form an open circuit. In a second state, the bimetallic disc actuator 18 is concave relative to the relatively moveable electrical contacts 14, 16, whereby the electrical contacts 14, 16 are moved together such that they form an closed circuit.

As illustrated in FIGS. 1 and 2, the thermal switch 10 includes the two terminal posts 20, 22 mounted in a header 24 such that they are electrically isolated from one anther. For example, terminal posts 20, 22 are mounted in the header 24 using a glass or epoxy electrical isolator 26 (shown in FIG. 1).

As shown in FIG. 2, the contact 14 is fixed on the lower end of one terminal post 20. The contact 16 is moveable on the end of a carrier 28 in the form of an armature spring, which is fixed in a cantilever fashion to the lower end of the other terminal post 22. The electrical contacts 14, 16 thus provide an electrically conductive path between the terminal posts 20, 22. Upward pivoting of the armature spring 28 moves the movable contact 16 out of engagement with the fixed contact 14, whereby an open circuit is created. Downward pivoting of the armature spring 28 moves the movable contact 16 into engagement with the fixed contact 14, whereby the terminal posts 20, 22 are shorted and the circuit is closed.

The movable contact 16 is controlled by the disc actuator 18, which is spaced away from the header 24 by a spacer ring 30 interfitted with a peripheral groove 32. A cylindrical case 34 fits over the spacer ring 30, thereby enclosing the terminal posts 20, 22, the electrical contacts 14, 16, and the disc actuator 18. The case 34 includes a base 36 with a pair of annular steps or lands 38 and 40 around the interior thereof and spaced above the base. The lower edge of the spacer ring 30 abuts the upper case land 40. The peripheral edge of the disc actuator 18 is captured within an annular groove created between the lower end of the spacer ring 30 and the lower case land 38.

As shown in FIG. 2, while the thermal switch 10 is maintained below a predetermined overheat temperature, the disc actuator 18 is maintained concave relationship to the electrical contacts 14, 16. The concave disc actuator 18 pivots the armature spring 28 upwardly to separate the contacts 14, 16 through the intermediary of a striker pin 42 fixed to the armature spring 28. Separation of the contacts 14 and 16 creates normally open circuit condition.

The electrical temperature sensor 12 is implemented as any of a resistance thermal device (RTD), a platinum resistance thermal device (PRTD), a thermistor, a thermocouple, or another suitable equivalent conventional electrical temperature sensor 12, and is mounted to the interior of the thermal switch 10 and electrically connected to the two terminal posts 20, 22. For example, the electrical temperature sensor 12 is bonded to an inner wall surface of the spacer ring 30 using a bonding agent 44, such as an epoxy. The bonding agent 44 is optionally a thermally conductive epoxy, such as a silver or aluminum-filled epoxy, that effectively thermally couples the electrical temperature sensor 12 to the exterior of the thermal switch 10, and thus to the sensed ambient temperature. Lead wires 46, 48 attached to the electrical temperature sensor 12 electrically coupled to each of the terminal posts 20, 22. For example, the lead wires 46, 48 are spot welded to an outer surface of the corresponding terminal post 20, 22. The output of the internal electrical temperature sensor 12 is available on the terminal posts 20, 22 while the electrical contacts 14, 16 provide an open circuit.

The thermal switch 10 is sealed to provide protection from physical damage. The thermal switch 10 is optionally hermetically sealed with a dry Nitrogen gas atmosphere having trace Helium gas to provide leak detection, thereby providing the internal electrical temperature sensor 12 with a clean, safe operating environment.

Figure 3:
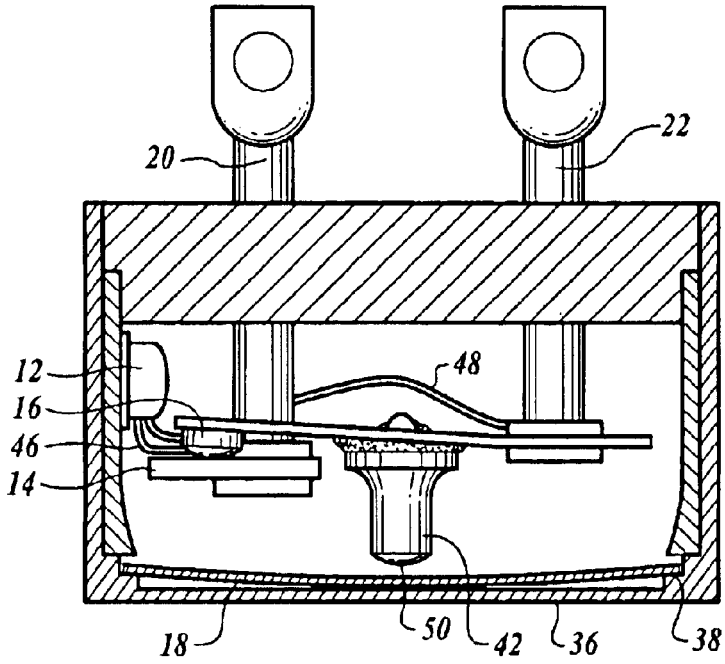
FIG. 3 is a cross-sectional view of the snap-action thermal switch of the present invention embodied as shown in FIG. 1 with the contacts closed.

FIG. 3 illustrates the thermal switch 10 as a closed circuit, wherein the contacts 14, 16 are shorted. In response to a increase in the sensed ambient temperature above a predetermined set point, the disc actuator 18 inverts in a snap-action into a concave relationship with the electrical contacts 14, 16, the disc actuator 18 entering a space between the lower case land 38 and the case end 36. The lower end 50 of the striker pin 42 is normally spaced a distance from the actuator disc 18 so that slight movement of the actuator disc 18 will not effect contact engagement. The armature spring 28 is pivoted downwardly, which moves the movable contact 16 into engagement with the fixed contact 14, thereby creating a short and closing the circuit. The output of the electrical temperature sensor 12 is not available when the electrical contacts 14, 16 are shorted and the circuit is closed. However, due to the nature of the snap-action disc actuator 18, the output of the electrical temperature sensor 12 becomes available again when the sensed ambient temperature is reduced below the predetermined set point and the disc actuator 18 returns to its convex state relative to the electrical contacts 14, 16, so that the electrical temperature sensor 12 is again presented with an open circuit on the two terminal posts 20, 22.

Figure 4:
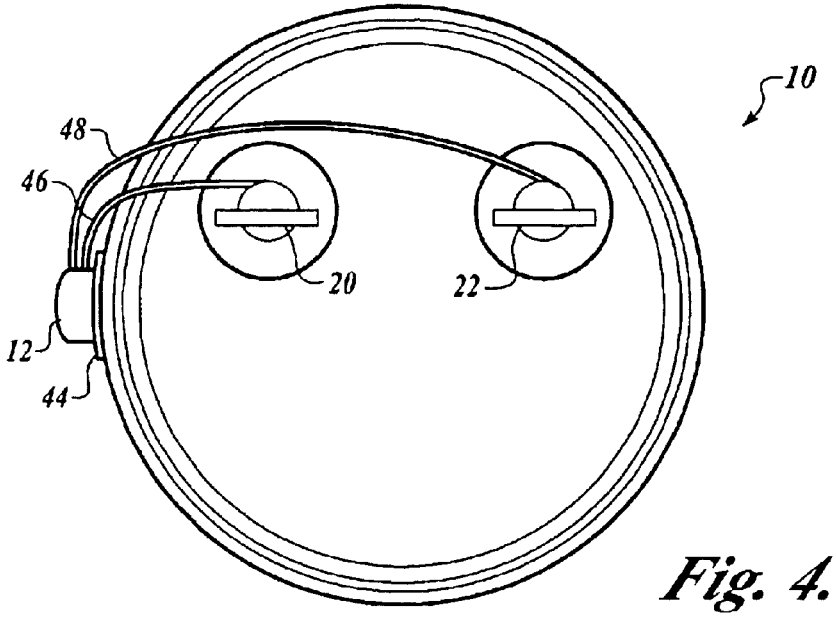
FIG. 4 is a top plan view of one alternative embodiment of the present invention embodied as a snap-action thermal switch having an externally mounted electrical temperature sensor.
Figure 5:
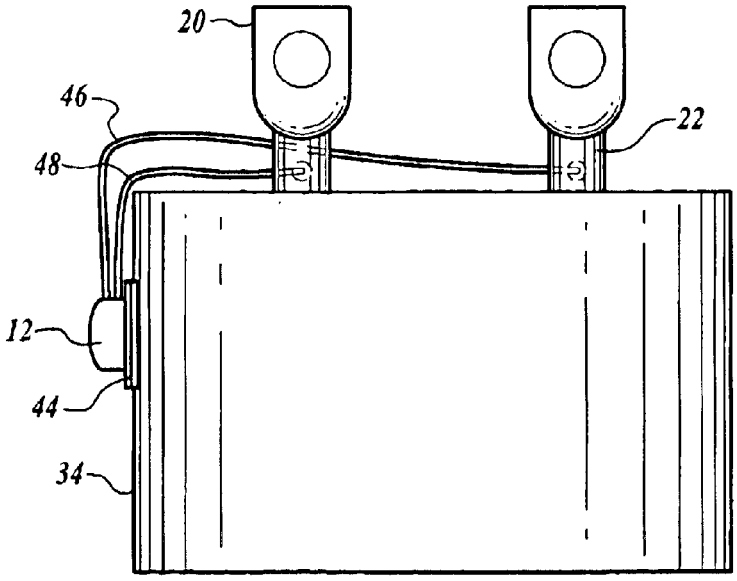
FIG. 5 is a side view of the snap-action thermal switch of the present invention embodied as shown in FIG. 4.
Figure 6:
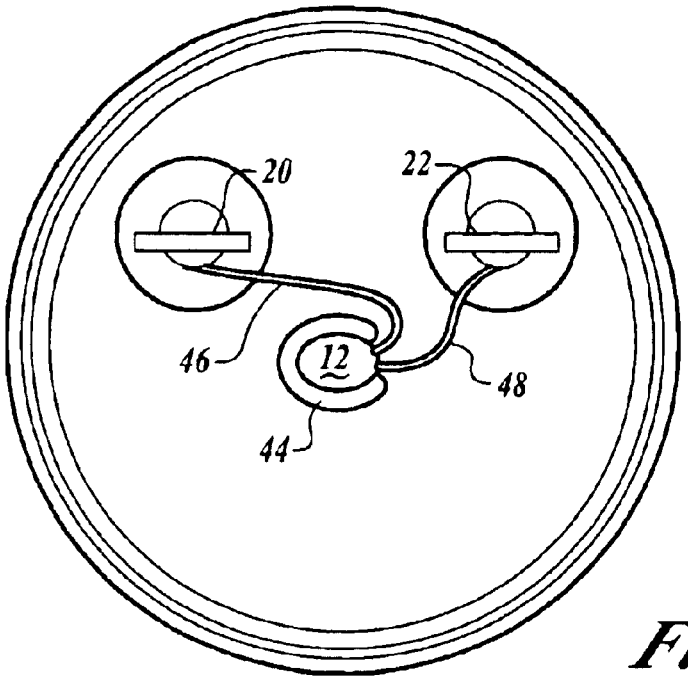
FIG. 6 is a top plan view of another alternative embodiment of the present invention embodied as a snap-action thermal switch having an externally mounted electrical temperature sensor.
Figure 7:
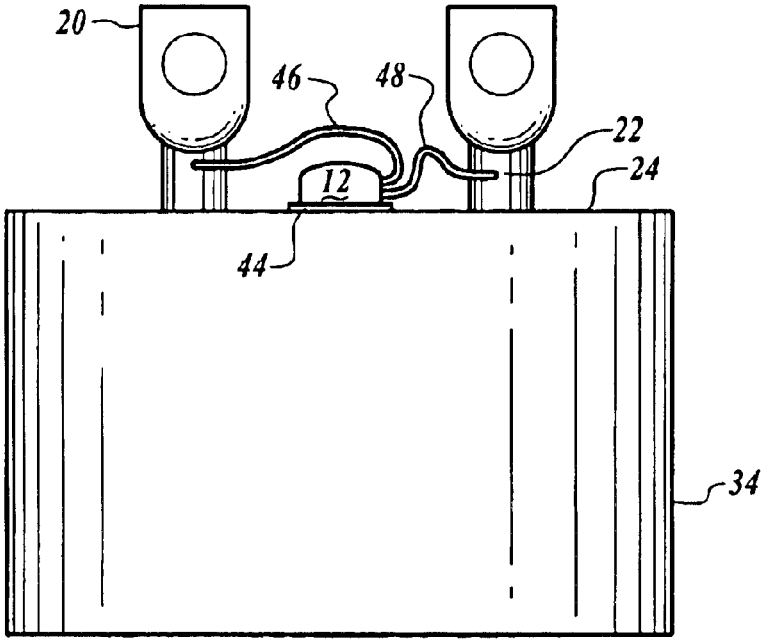
FIG. 7 is a side view of the snap-action thermal switch of the present invention embodied as shown in FIG. 6.

FIGS. 4–7 illustrate an alternate embodiment of the invention wherein the electrical temperature sensor 12 is installed on an exterior surface 52 of the thermal switch 10 and the lead wires 46, 48 are attached to exterior surfaces of the terminal posts 20, 22 of the thermal switch 10. The electrical temperature sensor 12 is, for example, bonded to the exterior surface 52 of the case 34, as shown in FIGS. 4–5. Alternatively, the electrical temperature sensor 12 is, for example, bonded to the exterior surface 54 of the header 24, as shown in FIGS. 6–7.

Another embodiment of the invention comprises installing a three-terminal temperature sensor to the thermal switch, and adding the third terminal to the thermal switch. According to such an embodiment, the electrical temperature sensor 12 is thermally coupled to the internal surface of the thermal switch and is contained within the clean, dry, hermetic enclosure, such that separate packaging and wiring of temperature sensors are eliminated and the ultimate in savings and reliability for installations requiring thermal regulation, protection and monitoring are provided.

Figure 8:
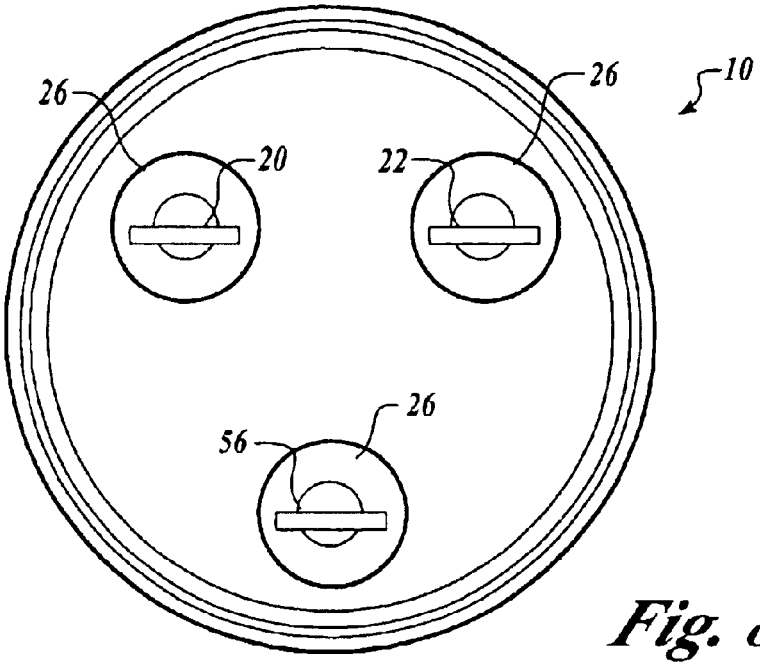
FIG. 8 is a top plan view of the present invention embodied as a snap-action thermal switch having a third terminal.

FIG. 8 shows that a third terminal is added to the thermal switch 10 in the form of a third terminal post 56, which is electrically isolated from the header 24 by another one of the glass or epoxy electrical isolators 26.

Figure 9:
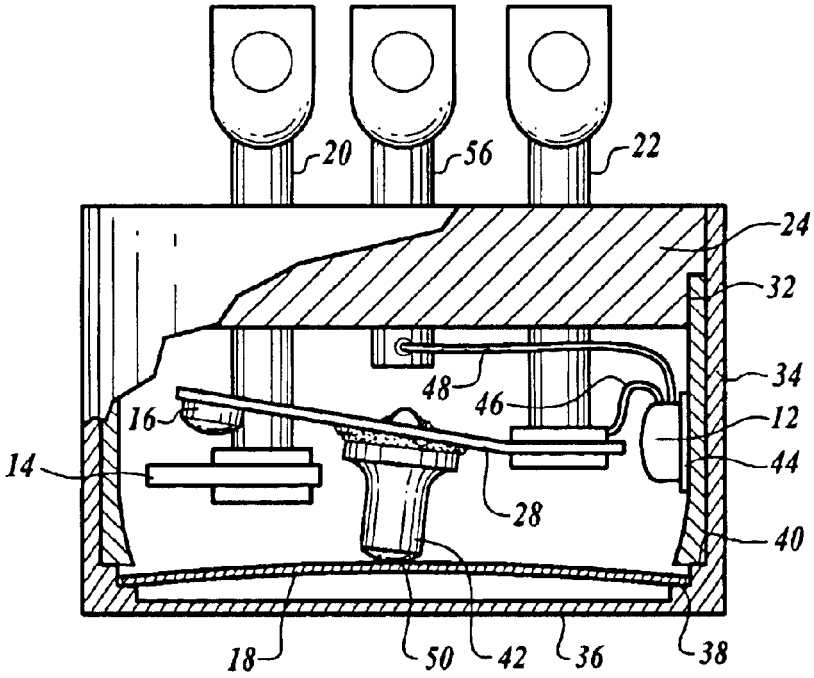
FIG. 9 is a side view of the snap-action thermal switch of the present invention embodied as shown in FIG. 8.

FIG. 9 shows that one of the lead wires 46 from the electrical temperature sensor 12 is electrically coupled to one of the terminal posts 20, 22. The other lead wire 48 from the electrical temperature sensor 12 is electrically coupled to the third terminal post 56. For example, the lead wires 46, 48 are spot welded to an outer surface of the corresponding terminal post 20 or 22 and 56. The output of the internal electrical temperature sensor 12 is available on one of the terminal posts 20 or 22 and the third terminal post 56, whether the electrical contacts 14, 16 are open or closed. When practiced using the embodiment shown in FIGS. 8 and 9, the thermal switch 10 of the invention is used to independently monitor the actual temperature of the device while providing positive overheat protection.

Figure 10A:
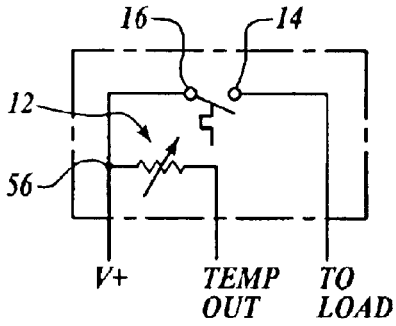
FIG. 10A is one exemplary electrical schematic of the circuit formed by the three-terminal thermal switch of the invention, as embodied in FIGS. 8 and 9 and employing a RTD, PRTD, a thermistor, a thermocouple, or another suitable equivalent conventional electrical temperature sensor.

FIG. 10A is an exemplary electrical schematic of the circuit formed by the thermal switch 10, as embodied in FIGS. 8 and 9, and employing a RTD, a PRTD, a thermistor, a thermocouple, or another suitable equivalent electrical temperature sensor 12.

Figure 10B:
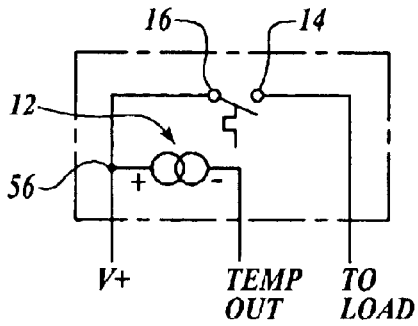
FIG. 10B is another exemplary electrical schematic of the circuit formed by the three-terminal thermal switch of the invention, as embodied in FIGS. 8 and 9, wherein the electrical temperature sensor is embodied as a high precision temperature monitoring device of a type of high-reliability, two-terminal, monolithic silicon transducer having a linear temperature output over a wide range of temperatures.

FIG. 10B is another exemplary electrical schematic of the circuit formed by the thermal switch 10, as embodied in FIGS. 8 and 9, wherein the electrical temperature sensor 12 is embodied as a high precision temperature monitoring device of a type of high-reliability, two-terminal, monolithic silicon temperature transducer having a substantially linear temperature output over a wide range of temperatures.

Figure 11A:
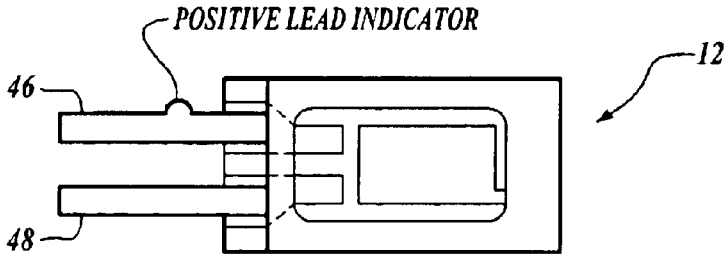
FIG. 11A is a top plan view of the a high precision temperature monitoring device utilized in the embodiment of FIG. 10B.
Figure 11B:
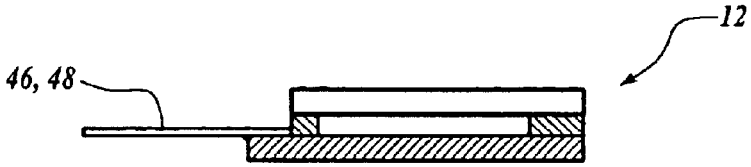
FIG. 11B is a side view of the high precision temperature monitoring device as shown in FIG. 11A.

FIGS. 11A and 11B are top and side view, respectively, that illustrate one example of such a temperature monitoring device 12, which is the model AD590 flat package, two-terminal temperature transducer microchip available commercially from Analog Devices, Norwood, Mass. (vendor CAGE number 24355).

The invention is not limited to the type of snap-action thermal switch 10 that is shown in FIGS. 1–9. Rather, the invention is optionally practiced using any normally open, positive close thermal indication device.

The AD590 device 12 shown in top view in FIG. 11A and in side view in FIG. 11B is a two-terminal integrated circuit temperature transducer that produces an output current proportional to absolute temperature. For supply voltages between +4 V and +30 V, the device acts as a high impedance, constant current regulator passing 1 $\mu$A/K. Thin-film resistor portions (not shown) of the AD590 microchip are laser trimmed to calibrate the device to 298.2 $\mu$A output at 298.2K (+25° C.).

The AD590 device can be used in any temperature sensing application below about +150° C. in which conventional electrical temperature sensors are currently employed. The inherent low cost of a monolithic integrated circuit combined with the elimination of support circuitry makes the AD590 device an attractive alternative for other temperature measurement devices 12 in the practice of the present invention. Linearization circuitry, precision voltage amplifiers, resistance measuring circuitry and cold junction compensation are not needed in applying the AD590 device.

The AD590 device is known to be particularly useful in remote sensing applications, such as the present invention. The AD590 device is insensitive to voltage drops over long lines due to its high impedance current output. Any well insulated twisted lead wire pair is sufficient for operation hundreds of feet from the receiving circuitry. The output characteristics also make the AD590 device easy to multiplex: the current can be switched by a CMOS multiplexer or the supply voltage can be switched by a logic gate output.

Figure 12:
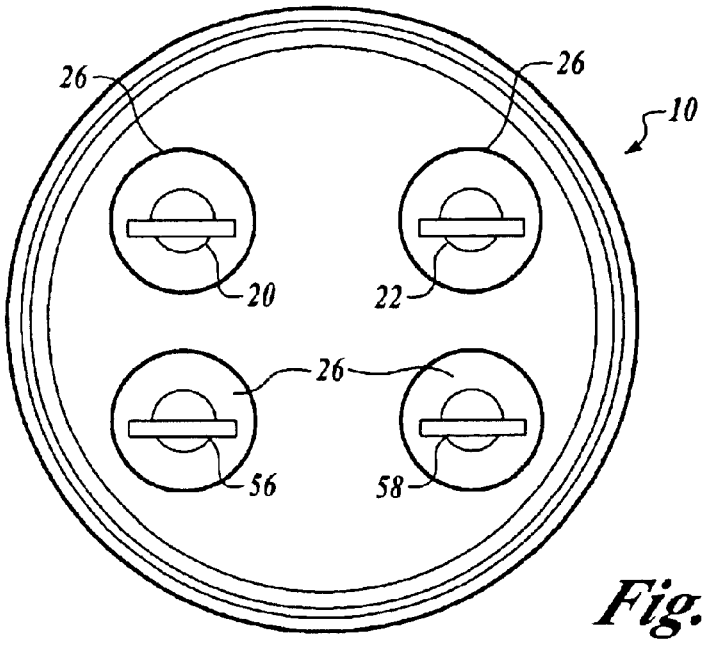
FIG. 12 is a top plan view of the invention embodied as a four-terminal thermal switch.
Figure 13:
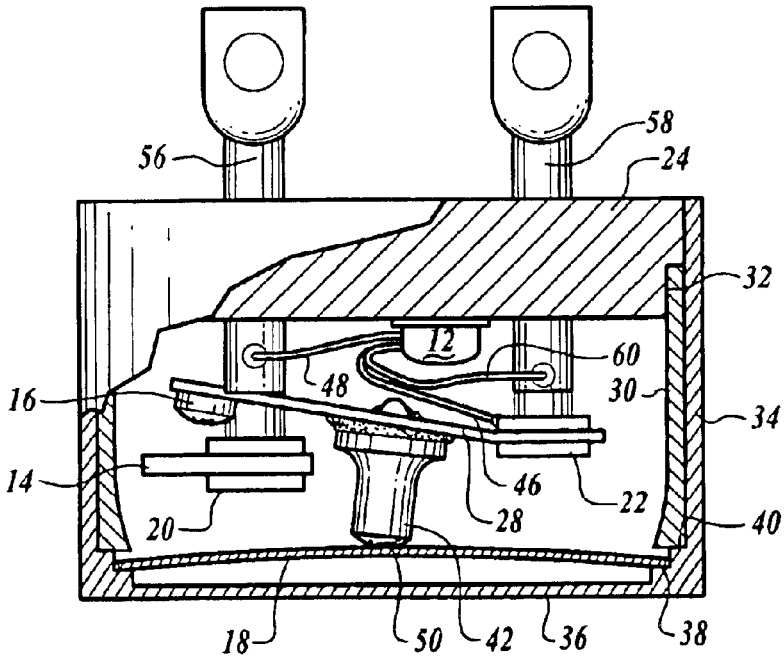
FIG. 13 is a side view of the invention embodied as a four-terminal thermal switch.

FIG. 12 is a top plan view of the invention embodied as a four-terminal thermal switch 10, and FIG. 13 is a side view. The four-terminal embodiment provides for compensation of the resistance in the wiring harness when accurate thermal measurement data is desired using the RTD, PRTD, thermistor, thermocouple, or other suitable equivalent conventional electrical temperature sensor 12. One of the two terminals of the temperature sensor 12 is coupled via one lead wire 46 to one of the two switch terminal posts 20, 22, as described above. The other terminal of the temperature sensor 12 is coupled via the other lead wire 48 to the third terminal post 56, and is further coupled to a fourth terminal post 58 by a third lead wire 60.

When practiced using the embodiment shown in FIGS. 12 and 13, the thermal switch 10 of the invention is used to monitor the actual temperature of the device while providing positive overheat protection. Furthermore, coupling the third lead wire 60 to the fourth terminal post 58 permits measurement of the resistance in the wiring harness so that compensation can be administered, thereby making more accurate the temperature measurement provided by the temperature sensor 12.

Figure 14:
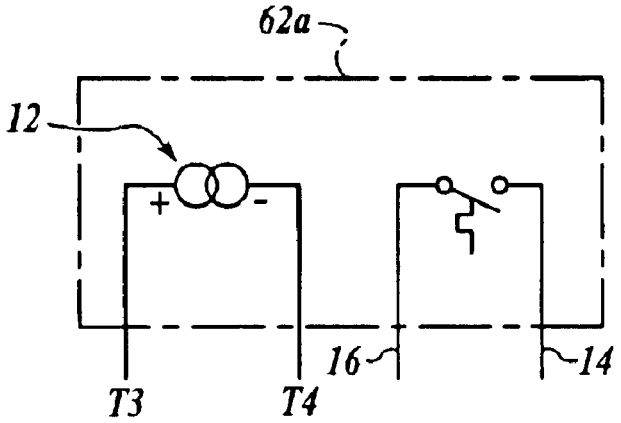
FIG. 14 illustrates a first circuit for use with the embodiment of the four-terminal thermal switch of the invention, as shown in FIGS. 12 and 13.

FIG. 14 illustrates a circuit 62*a* that is compatible with the embodiment of the invention as described above and shown in FIGS. 12 and 13, wherein the temperature monitoring device 12 is embodied as the model AD590 described herein. The temperature monitoring device 12 is accessed via terminals T3 and T4.

Figure 15:
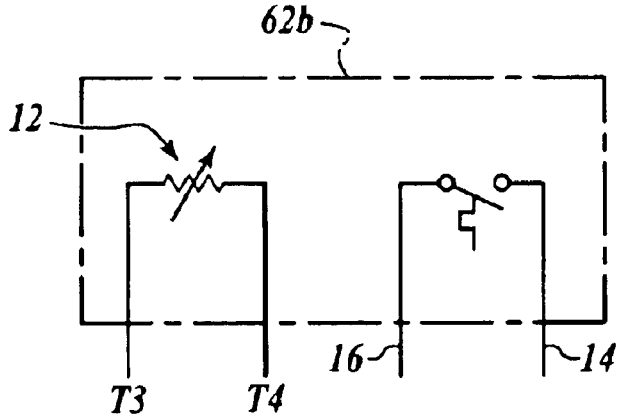
FIG. 15 illustrates a second circuit for use with the embodiment of the four-terminal thermal switch of the invention, as shown in FIGS. 12 and 13.

FIG. 15 illustrates a second circuit 62*b* that is also compatible with the embodiment of the invention as described above and shown in FIGS. 12 and 13. The temperature monitoring device 12 is embodied as the model AD590 described herein, and the temperature monitoring device 12 is accessed via terminals T3 and T4.

Figure 16:
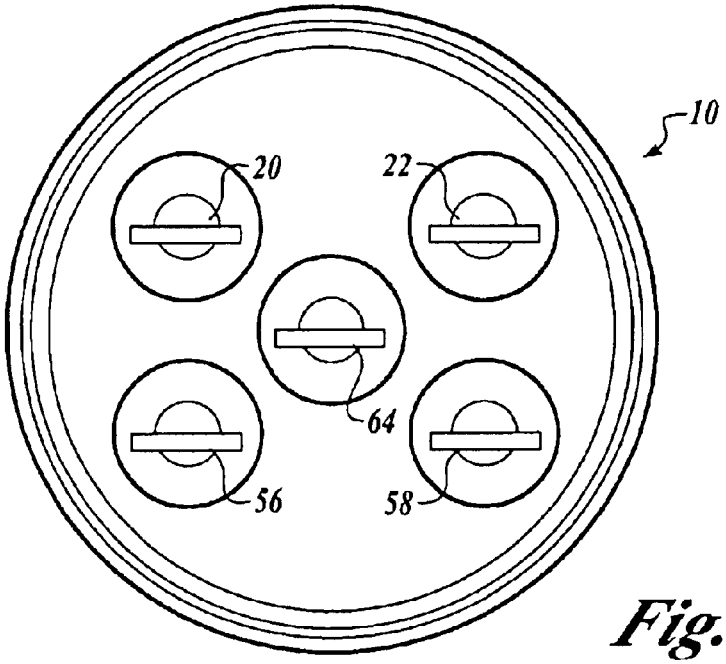
FIG. 16 is a top plan view of the invention embodied as a five-terminal thermal switch.
Figure 17:
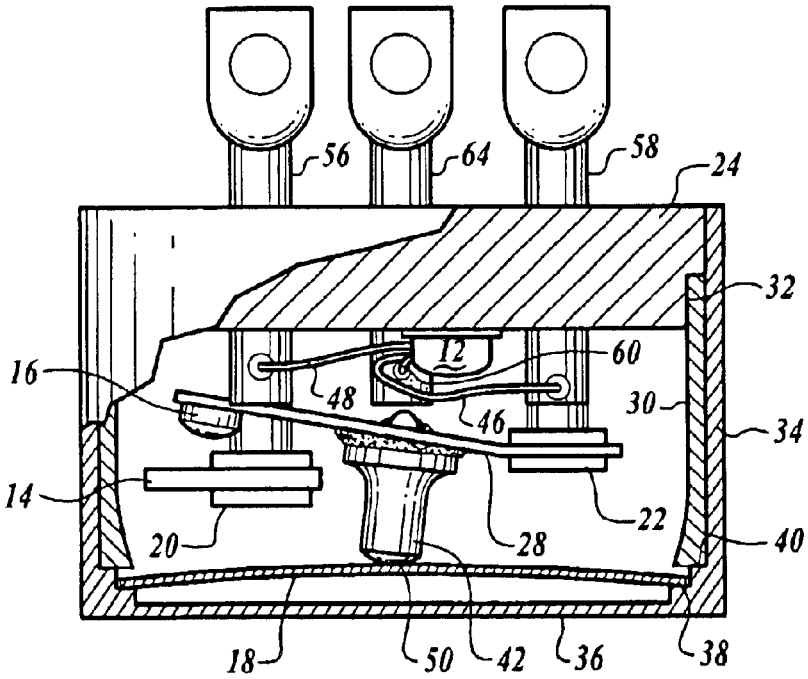
FIG. 17 is a side view of the invention embodied as a five-terminal thermal switch.

FIG. 16 is a top plan view of the invention embodied as a five-terminal thermal switch 10, and FIG. 17 is a side view. The five-terminal embodiment provides for compensation of the resistance in the wiring harness when accurate thermal measurement data is desired using the integral electrical temperature sensor 12 embodied as a RTD or PRTD.

Figure 18:
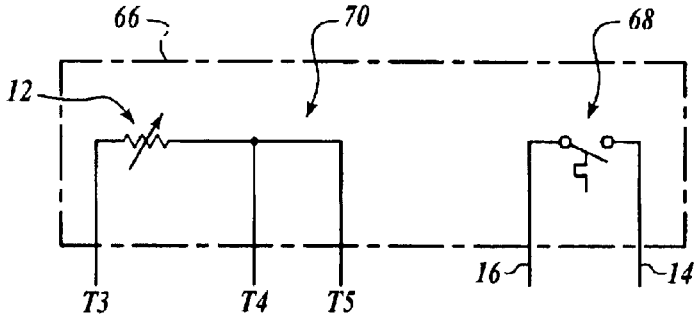
FIG. 18 illustrates a circuit that is compatible with the embodiment of the invention as described above and shown in FIGS. 16 and 17.

FIG. 18 illustrates a circuit 66 that is compatible with the embodiment of the invention as described above and shown in FIGS. 16 and 17. The five-terminal embodiment completely separates a circuit 68 of the snap-action portion of the thermal switch 10 from a circuit 70 having the integral temperature sensor 12 embodied as a RTD or PRTD. The electrical contacts 14, 16 of the snap-action thermal switch 10 are coupled to the first terminal posts 20 and 22. The lead wires 46, 48, and 60 are coupled to the respective second terminal posts 58, 56, and 64, as shown in FIG. 17.

When practiced using the embodiment shown in FIGS. 16 and 17, the thermal switch 10 of the invention is used to monitor the actual temperature of the device completely independently of the positive overheat protection portion of the thermal switch 10. Furthermore, coupling the third lead wire 60 to the fourth terminal post 58 permits measurement of the resistance in the wiring harness so that compensation can be administered, thereby making more accurate the temperature measurement provided by the temperature sensor 12 embodied as a RTD or PRTD.

While the preferred embodiment of the invention has been illustrated and described, it will be appreciated that various changes can be made therein without departing from the spirit and scope of the invention.

What is claimed is:

1. A multiple output thermal detection and protection device, comprising:

a two-terminal snap-action thermal switch structured in a normally open configuration and having a thermally activated snap-action portion that is electrically coupled between two mutually electrically isolated terminals that are both electrically isolated from a housing containing the snap-action portion; and an electrical temperature sensor that is both thermally and electrically coupled to the snap-action thermal switch wherein the electrical temperature sensor is mounted on an interior surface of the snap-action thermal switch using a thermally conductive bonding agent.

2. The device of claim 1 wherein the electrical temperature sensor and the snap-action thermal switch output a signal representative of temperature using one or more electrical terminals in common.

3. The device of claim 2 wherein the snap-action thermal switch is structured to be normally open at sensed temperatures below a predetermined set point;

the two-terminal snap-action thermal switch includes two terminals that are mutually electrically isolated when the snap-action thermal switch structured in the normally open configuration; and the integral electrical temperature sensor is electrically coupled across the two isolated terminals.

4. The device of claim 3 wherein electrical contact portions of the two isolated terminals are closed at sensed temperatures above a predetermined set point.

5. The device of claim 2 wherein the two-terminal snap-action thermal switch includes two electrical terminals that are mutually electrically isolated when the snap-action thermal switch structured in the normally open configuration;

the snap-action thermal switch is structured to be in one of the normally open and a normally closed configuration at sensed temperatures below a predetermined set point;

further comprising a third electrical terminal that is mutually electrically isolated from the two electrical terminals of the two-terminal snap-action thermal switch; and wherein one of the two isolated terminals of the two-terminal snap-action thermal switch is shared by one terminal of the integral electrical temperature sensor, and a second terminal of the integral electrical temperature sensor is electrically coupled to the third electric terminal.

6. The device of claim 5 wherein the shared one of the two isolated terminals of the two-terminal snap-action thermal switch is structured to be coupled to a voltage source, a second one of the two isolated terminals is structured to be coupled to a load, and the output of the integral electrical temperature sensor is coupled to the third electrical terminal.

7. The device of claim 6 wherein the integral electrical temperature sensor is an electrical temperature sensor selected from a group of electrical temperature sensors that includes a resistance thermal device (RTD), a platinum resistance thermal device (PRTD), a thermistor, a thermocouple, and a monolithic silicon temperature transducer.

8. The device of claim 6 wherein the integral electrical temperature sensor is a flat package, two-terminal temperature transducer microchip.

9. A multiple output the thermal detection and protection device, comprising:

a two-terminal snap-action thermal switch structured in a normally open configuration and having a thermally activated snap-action portion that is electrically coupled between two mutually electrically isolated terminals that are both electrically isolated from a housing containing the snap-action portion; and an electrical temperature sensor that is both thermally and electrically coupled to the snap-action thermal switch wherein the electrical temperature sensor is mounted on an exterior surface of the snap-action thermal switch using a bonding agent.

10. The device of claim 9 wherein the electrical temperature sensor and the snap-action thermal switch output a signal representative of temperature using one or more electrical terminals in common.

11. The device of claim 10 wherein the snap-action thermal switch is structured to be normally open at sensed temperatures below a predetermined set point;

the two-terminal snap-action thermal switch includes two terminals that are mutually electrically isolated when the snap-action thermal switch structured in the normally open configuration; and the integral electrical temperature sensor is electrically coupled across the two isolated terminals.

12. The device of claim 11 wherein electrical contact portions of the two isolated terminals are closed at sensed temperatures above a predetermined set point.

13. The device of claim 10 wherein the two-terminal snap-action thermal switch includes two electrical terminals that are mutually electrically isolated when the snap-action thermal switch structured in the normally open configuration;

the snap-action thermal switch is structured to be in one of the normally open and a normally closed configuration at sensed temperatures below a predetermined set point;

further comprising a third electrical terminal that is mutually electrically isolated from the two electrical terminals of the two-terminal snap-action thermal switch; and wherein one of the two isolated terminals of the two-terminal snap-action thermal switch is shared by one terminal of the integral electrical temperature sensor, and a second terminal of the integral electrical temperature sensor is electrically coupled to the third electrical terminal.

14. The device of claim 13 wherein the shared one of the two isolated terminals of the two-terminal snap-action thermal switch is structured to be coupled to a voltage source, a second one of the two isolated terminals is structured to be coupled to a load, and the output of the integral electrical temperature sensor is coupled to the third electrical terminal.

15. The device of claim 14 wherein the integral electrical temperature sensor is an electrical temperature sensor selected from a group of electrical temperature sensors that includes a resistance thermal device (RTD), a platinum resistance thermal device (PRTD), a thermistor, a thermocouple, and a monolithic silicon temperature transducer.

16. The device of claim 14 wherein the integral electrical temperature sensor is a flat package, two-terminal temperature transducer microchip.

17. A multiple output thermal detection and protection device, comprising:

first and second terminals extending through a substantially planar header and being electrically isolated therefrom;

a first stationary contact adjacent to one end of the first terminal;

a second contact adjacent to one end of the second terminal and being movable between a first position spaced away from the first stationary contact in an open circuit structure and a second position in contact with the first stationary contact in a closed circuit structure;

an upright tubular spacer projecting from the header and surrounding the first and second contacts and the portions of the first and second terminals adjacent to the contacts;

a housing enclosing the spacer, the first and second contacts, and the portions of the first and second terminals adjacent to the contacts, the housing extending beyond the spacer and cooperating with the spacer to form an annular space therebetween spaced away from the contacts;

a disc actuator captured within the annular space and being responsive to a sensed temperature to change state between a concave and a convex relationship to the electrical contacts, such that the disc actuator spaces the movable contact away from the stationary contact when in the concave relationship and the disc actuator permits the movable contact to contact the stationary contact when in the convex relationship; and an electrical temperature sensor sharing one or more of the first and second terminals in common with the respective first and second contacts and being structured to provide an output representative of the sensed temperature.

18. The device of claim 17 wherein the disc actuator is a bi-metallic disc being structured to change state at a predetermined sensed temperature.

19. The device of claim 18 wherein the disc actuator is structured to be in the concave relationship to the electrical contacts when the sensed temperature is below the predetermined sensed temperature.

20. The device of claim 19 wherein the electrical temperature sensor shares both of the first and second terminals in common with the respective first and second contacts and being structured to provide an output representative of the sensed temperature on one of the first and second terminals when the sensed temperature is below the predetermined sensed temperature.

21. The device of claim 20 wherein the electrical temperature sensor is one of a resistance thermal device (RTD), a platinum resistance thermal device (PRTD), a thermistor, a thermocouple, and a monolithic silicon temperature transducer.

22. The device of claim 18 wherein the disc actuator is structured to be in one of the concave and convex relationships to the electrical contacts when the sensed temperature is below the predetermined sensed temperature;

a third terminal extends through the header and being electrically isolated therefrom, and the electrical temperature sensor shares one of the first and second terminals in common with the respective first and second contact and is electrically coupled to the third terminal to provide an output representative of the sensed temperature thereon.

23. The device of claim 22 wherein the electrical temperature sensor is one of a resistance thermal device (RTD), a platinum resistance thermal device (PRTD), a thermistor, a thermocouple, and a monolithic silicon temperature transducer.

24. A multiple output thermal detection and protection device, comprising:

first and second terminals extending through a substantially planar header and being electrically isolated therefrom;

a first stationary contact adjacent to one end of the first terminal;

a second contact adjacent to one end of the second terminal and being movable between a first position spaced away from the first stationary contact in an open circuit structure and a second position in contact with the first stationary contact in a closed circuit structure;

an upright tubular spacer projecting from the header and surrounding the first and second contacts and the portions of the first and second terminals adjacent to the contacts;

a housing enclosing the spacer, the first and second contacts, and the portions of the first and second terminals adjacent to the contacts, the housing extending beyond the spacer and cooperating with the spacer to form an annular space therebetween spaced away from the contacts;

a bi-metallic disc actuator being structured to change state at a preselected sensed temperature and being captured within the annular space and being responsive to a sensed temperature to change state between a concave and a convex relationship to the electrical contacts, such that the disc actuator spaces the movable contact away from the stationary contact when in the concave relationship and the disc actuator permits the movable contact to contact the stationary contact when in the convex relationship, wherein the disc actuator is structured to be in one of the concave and convex relationships to the electrical contacts when the sensed temperature is below the preselected sensed temperature;

a third terminal and a fourth terminal extend through the header and each being electrically isolated therefrom; and an electrical temperature sensor is coupled to the third and fourth terminals in an independent circuit from the electrical contacts actuated by the disc actuator and being structured to provide to provide an independent output representative of the sensed temperature thereon.

25. The device of claim 24 wherein the electrical temperature sensor is one of a resistance thermal device (RTD), a platinum resistance thermal device (PRTD), a thermistor, a thermocouple, and a monolithic silicon temperature transducer.

26. The device of claim 25 wherein the electrical temperature sensor is coupled to each of the third and fourth terminals and to one of the first and second terminals.

27. The device of claim 24, further comprising a fifth terminal extending through the header and being electrically isolated therefrom; and wherein the electrical temperature sensor is a monolithic silicon temperature transducer being electrically coupled to at least two of the third, fourth and fifth terminal.

28. A three-terminal multiple output thermal detection and protection device, comprising:

first, second and third terminals, extending through and on either side of a substantially planar header and being electrically isolated therefrom and from one another;

a first stationary contact fixed adjacent to one end of the first terminal;

a second contact fixed adjacent to one end of the second terminal and being movable between a first position spaced away from the first stationary contact in an open circuit structure and a second position in contact with the first stationary contact in a closed circuit structure;

an upright tubular spacer affixed to and projecting from the one side of the header and surrounding the first and second contacts, the portions of the first and second terminals adjacent to the contacts, and the third terminal;

a housing enclosing the spacer, the first and second contacts, the portions of the first and second terminals adjacent to the contacts, and the third terminal, the housing extending beyond the spacer and cooperating with the spacer to form a space therebetween spaced away from the contacts;

a disc actuator captured within the space between the spacer and the housing and being responsive to a sensed temperature for changing state between a first pressing upon and a second spaced away relationship to the movable electrical contact, such that the disc actuator spaces the movable contact away from the stationary contact when in the first pressing upon relationship and the disc actuator permits the movable to move into contact with the stationary contact when in the second spaced away relationship; and an electrical temperature sensor sharing one of the first and second terminals in common with the respective first and second contacts and being coupled to the third terminal for providing an output signal representative of the sensed temperature.

29. The device of claim 28 wherein the disc actuator is structured to be in one of the first pressing upon relationship and the second spaced away relationship to the electrical contacts when the sensed temperature is below the predetermined sensed temperature.

30. The device of claim 28 wherein the electrical temperature sensor is one of a resistance thermal device (RTD), a platinum resistance thermal device (PRTD), a thermistor, a thermocouple, and a monolithic silicon temperature transducer.

31. A four-terminal multiple output thermal detection and protection device, comprising:

first, second, third and fourth terminals extending through and on either side of a substantially planar header and being electrically isolated therefrom and from one another;

a first stationary contact fixed adjacent to one end of the first terminal;

a second contact fixed adjacent to one end of the second terminal and being movable between a first position spaced away from the first stationary contact in an open circuit structure and a second position in contact with the first stationary contact in a closed circuit structure;

an upright tubular spacer affixed to and projecting from the one side of the header and surrounding the first and second contacts, the portions of the first and second terminals adjacent to the contacts, and the third terminal;

a housing enclosing the spacer, the first and second contacts, the portions of the first and second terminals adjacent to the contacts, and the third terminal, the housing extending beyond the spacer and cooperating with the spacer to form a space therebetween spaced away from the contacts;

a disc actuator captured within the space between the spacer and the housing and being responsive to a sensed temperature for changing state between a first pressing upon and a second spaced away relationship to the movable electrical contact, such that the disc actuator spaces the movable contact away from the stationary contact when in the first pressing upon relationship and the disc actuator permits the movable to move into contact with the station contact when in the second spaced away relationship; and an electrical temperature sensor electrically coupled between the third and fourth terminals for providing an output signal representative of the sensed temperature.

32. The device of claim 31 wherein the electrical temperature sensor is one of a resistance thermal device (RTD), a platinum resistance thermal device (PRTD), a thermistor, a thermocouple, and a monolithic silicon temperature transducer.

33. The device of claim 31 further comprising a fifth terminal extending through and on either side of a substantially planar header and being electrically isolated therefrom and from each of the first, second, third, and fourth terminals; and wherein the electrical temperature sensor is a monolithic silicon temperature transducer being electrically coupled to at least two of the third, fourth and fifth terminals.

34. A method for providing thermal detection an protection in a single device, the method comprising:

sensing temperature with an electrical temperature sensor portion of a first circuit that is electrically isolated from a housing supporting the first circuit;

outputting on the first circuit a first signal representative of the sensed temperature;

sensing a predetermined set point temperature; and in response to sensing the predetermined set point temperature, positively closing a second circuit that is electrically isolated from the housing which also supports the second circuit and outputting on at least one common terminal with the first circuit a second signal representative of the sensed set point temperature.

35. The method of claim 34 wherein closing the second circuit shorts the first circuit.

36. The method of claim 34 wherein sensing temperature with an electrical temperature sensor portion of a first circuit is operated after positively closing the second circuit.

* * * * *